US005741124A

United States Patent [19]

Mazzucato et al.

[11] Patent Number: 5,741,124

[45] Date of Patent: Apr. 21, 1998

[54] DOUBLE INSULATED ELECTRICALLY DRIVEN WATER PUMP

[75] Inventors: Roberto Mazzucato, Milan; Carlo A. Cuneo, Crema, both of Italy; Gus Alexander, Hoffman Estates, Ill.

[73] Assignee: Officine Meccaniche FAIP S.r.l., Italy

[21] Appl. No.: 516,497

[22] Filed: Aug. 17, 1995

[51] Int. Cl.[6] ..... F04B 17/00

[52] U.S. Cl. ..... 417/415; 417/368; 417/271

[58] Field of Search ..... 417/271, 415, 417/368

[56] References Cited

U.S. PATENT DOCUMENTS

| | | | |
|---|---|---|---|
| 1,846,360 | 2/1932 | Rudolph . | |
| 1,901,501 | 3/1933 | Ferris . | |
| 1,996,789 | 4/1935 | Baker | 417/271 X |
| 2,956,730 | 10/1960 | Hamilton et al. | 417/415 X |
| 3,106,057 | 10/1963 | Manning et al. . | |
| 4,529,362 | 7/1985 | Ichiryu et al. | 417/271 |
| 4,557,669 | 12/1985 | Vanderjagt . | |
| 4,567,456 | 1/1986 | Legatti | 335/20 |
| 4,792,096 | 12/1988 | Gregory | 239/113 |
| 4,851,724 | 7/1989 | Polk et al. | 310/68 |
| 5,201,638 | 4/1993 | Bieri . | |
| 5,314,096 | 5/1994 | Fesl et al. | 222/401 |
| 5,395,053 | 3/1995 | Frech | 239/227 |

FOREIGN PATENT DOCUMENTS 2480865 10/1981 France .

*Primary Examiner*—Timothy Thorpe
*Assistant Examiner*—Ted Kim
*Attorney, Agent, or Firm*—Leydig, Voit & Mayer, Ltd.

[57] ABSTRACT

In order to protect a user from receiving an electric shock, an electric motor driven high pressure water pump system having an electric motor, a pump associated with the electric motor via of a direct drive shaft, and a fan housing wherein the electric motor driven high pressure pump includes a first insulator surrounding the direct drive shaft and electrically isolating the drive shaft and pump housing, from the electric motor and at least one insulator ring, dividing the electric motor stator from the pump housing.

11 Claims, 7 Drawing Sheets

DOUBLE INSULATED ELECTRICALLY DRIVEN WATER PUMP

BACKGROUND OF THE INVENTION (1) Field of the Invention

This invention relates to a double insulated electrically driven water pump. More particularly, this invention relates to a high pressure cleaning device having a pump, an electric motor, and a housing. The pump and electric motor are arranged in the housing so that the motor directly drives the pump. The pump accepts water through an inlet port, pressurizes the water, and directs the pressurized water to an outlet port. The electric motor is electrically insulated from the water pump by two discreet insulators. The first insulator is located between the pump drive shaft and the electric motor rotor. The second insulators are located on each end of the electric motor stator and electrically insulate the electric motor and the pump housing and the electric motor fan housing.

(2) Description of the Art

Small high pressure water pumps driven by internal combustion engines and electric motors are well known in the art and are shown, for example, in U.S. Pat. No. 5,395,052. Electric motor driven high pressure pumps typically include a ground fault interrupter to protect the user from receiving an electric shock in the event that an electric circuit is created between the electric motor and the high pressure pump. An example of such an interrupter is found in U.S. Pat. No. 4,567,455.

One high pressure water pump that is driven by an electric notor is being sold that does not include a ground fault interrupter or similar safety measure. This high pressure water pump includes a high speed brush based electric motor. The motor is kept electrically insulated from the pump and other parts of the pump by a plastic bearing ring located in the gear box dividing the electric motor from the pump. Additionally, the electric motor housing is constructed of plastic in order to further protect the user from electric shock. The prior art solution to protecting the high pressure pump user from electric shock without using a ground fault interrupter is not useful, however, for a high pressure cleaning system that uses a direct drive electric induction motor.

SUMMARY OF THE INVENTION

Small high pressure water pumps are gaining popularity among consumers for washing everything from automobiles to aluminium siding. Consumer high pressure water pumps are small, reliable, and affordable. Many of the high pressure water pumps sold to consumers are driven by electric motors and incude large, bulky, and expensive ground fault interrupters to protect the user from receiving an inadvertent electric shock. Quite often, the ground fault interrupters exist as a large box on the electric cable that supplies electricity to the electric motor. This invention eliminates the need to use a ground fault interrupter in association with high pressure water pumping systems operated by an electrical induction motor. According to the present invention, the elimination of the ground fault interrupter is achieved by using a double insulation system to isolate the electric motor from the pump and other exposed portions of high pressure pumping system.

It is an object of this invention, therefore, to provide a high pressure water pump driven by an electric motor that includes double insulation that protects the user from electric shock.

It is yet another object of this invention to provide a high pressure water pump driven by an electric motor that includes double insulation instead of an expensive ground fault interrupter.

It is still another object of this invention to provide a high pressure water pump driven by a direct drive electric motor that includes an insulating material associated with the pump drive shaft that is resistant to wear.

In one embodiment, this invention is a high pressure water pump including an electric motor and an axial drive pump. The electric motor includes a stator having a first end and a second end and, inside the stator, a cylindrical rotor having a hollow core, a first open end and a second open end. A cable including a plurality of lead wires links the stator with a source of electricity. An axial drive pump is associated with the second end of the stator. The axial drive pump is driven by a drive shaft having a first end associated with a fan and a second end associated with the axial drive pump. The drive shaft is press fit into the hollow rotor core such that the first and second drive shaft ends extend beyond the first and second open rotor ends. A drive shaft insulator is positioned between the drive shaft and the rotor to keep the drive shaft electrically isolated from the electric motor stator and rotor. A first insulator ring is located between the stator second end and the axial drive pump to electrically isolate the axial drive pump from the rotor and stator combination. An optional second insulator ring may be located between the stator first end and a fan housing.

In another embodiment, this invention is a high pressure water pump including an electric motor associated with an axial drive piston pump. A drive shaft is rotated by the electric motor and directly drives the axial drive piston pump. The electric motor includes a stator having a first end and a second end. A cable including multiple lead wires is associated with the stator and is used to unite the stator with a source of electricity. A rotor having a hollow core is centered within but does not touch the stator. The rotor has a first open and a second open end. The rotor is press fit over the drive shaft and the drive shaft/rotor combination passes through the stator. A drive shaft first end is associated with a fan and is stabilized by a first bearing associated with a fan housing. A drive shaft second end is associated with the axial drive pump and is stabilized by a second bearing located between the electric motor and the axial drive pump. A drive shaft insulator manufactured from an electricaly insulated material is located between the drive shaft and the rotor. The drive shaft insulator prevents an electric current from passing between the rotor and the drive shaft. A first insulator ring also manufactured of an electrically insulated material electrically separates the stator second end and the axial drive pump. The first insulator ring prevents an electric current from passing between the electric motor and the axial drive pump housing. Finally, a second insulator ring, manufactured of an electrically insulating material separates the stator first end and the fan housing. The second insulator ring prevents an electric current from passing from the electric motor into the fan housing.

DESCRIPTION OF THE DRAWINGS

There is shown in the drawings a presently preferred embodiment of an electric motor driven double insulated high pressure water pump of this invention wherein like numerals in the various Figures pertain to like elements and wherein.

Figure 1:
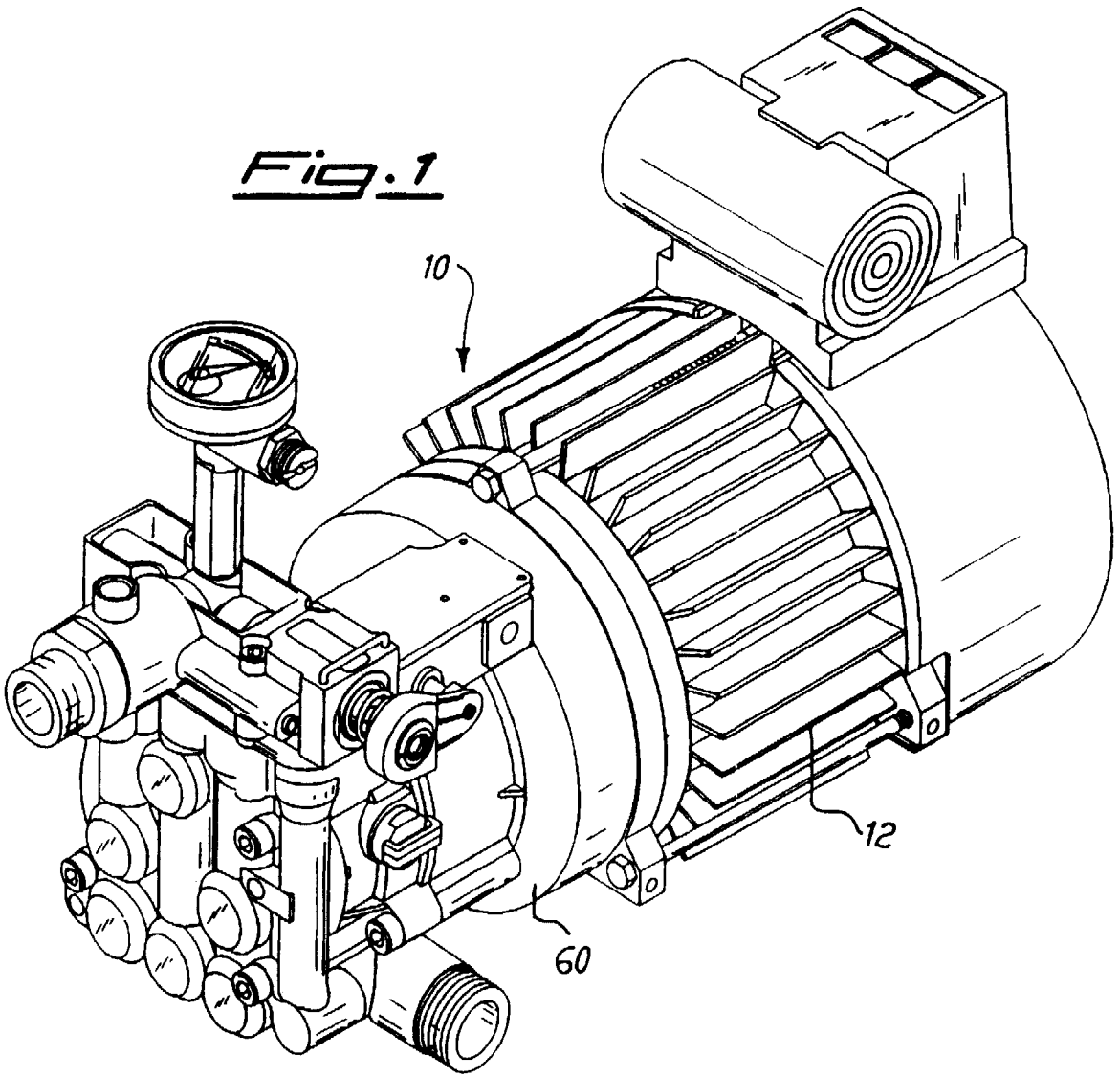
FIG. 1 is a perspective view of an electric motor driven double insulated high pressure pump of this invention.
Figure 2:
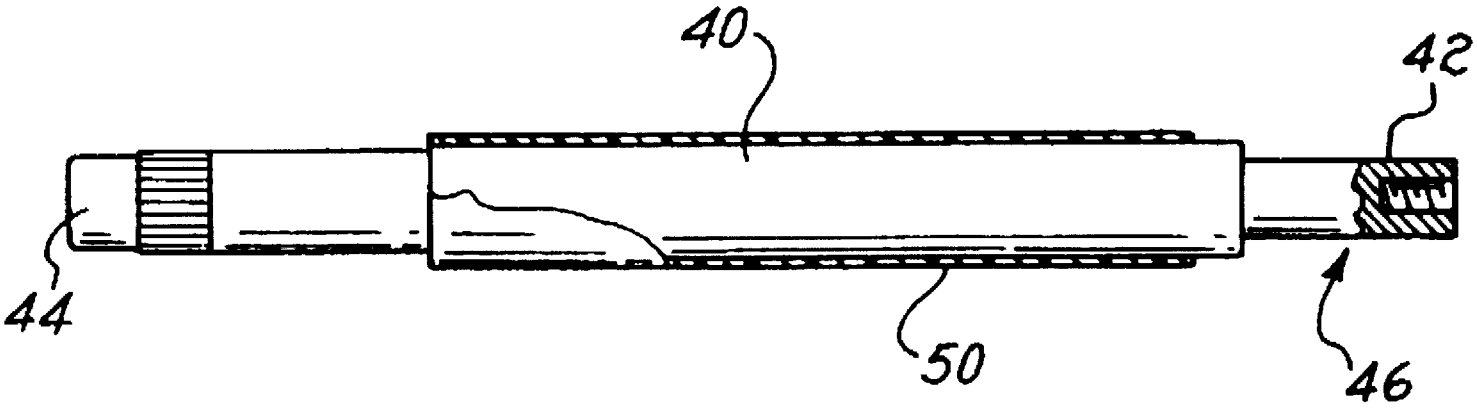
FIG. 2 is a cross-section view of a drive shaft including a drive shaft insulator that is associated with an electric motor driven double insulated pump of this invention.

It should be understood that terms used herein such as "top", "bottom", "end", "first", "second", "inside", and "associated with" have reference ony to the structure shown in the drawings as they would appear to a person viewing the drawings and are used merely to simplify the description of the invention. The figures are drawn to show the basic teachings of the present invention including the position in relationship of parts that perform various embodiments of this invention. Unless explained in detail the dimensions, dimensional proportions, materials of construction and so forth are well within the understanding of those skilled in the art.

DESCRIPTION OF CURRENT EMBODIMENTS

The present invention relates to a high pressure water pump driven by an electric motor. The high pressure water pump system is double insulated to protect a pump user from unwanted electric shock. The double insulation eliminates the need to use a ground fault interrupter circuit in the device.

The high pressure water pump system of this invention is generally designated as 10 in the associated figures. A perspective view of the assembled electric motor driven, high pressure water pump system of this invention is shown in FIG. 1. High pressure water pump system 10 generally includes an electric motor 12, an axial drive pump 60 and an electric cable 20. In most instances, the electric motor driven high pressure water pump 10 is contained within a plastic housing. The plastic housing protects the electrically driven high pressure water pump system 10 from damage, it is aesthetically pleasing, and in some cases, when the housing includes wheels, it provides a means of transporting the pump system.

Figure 4:
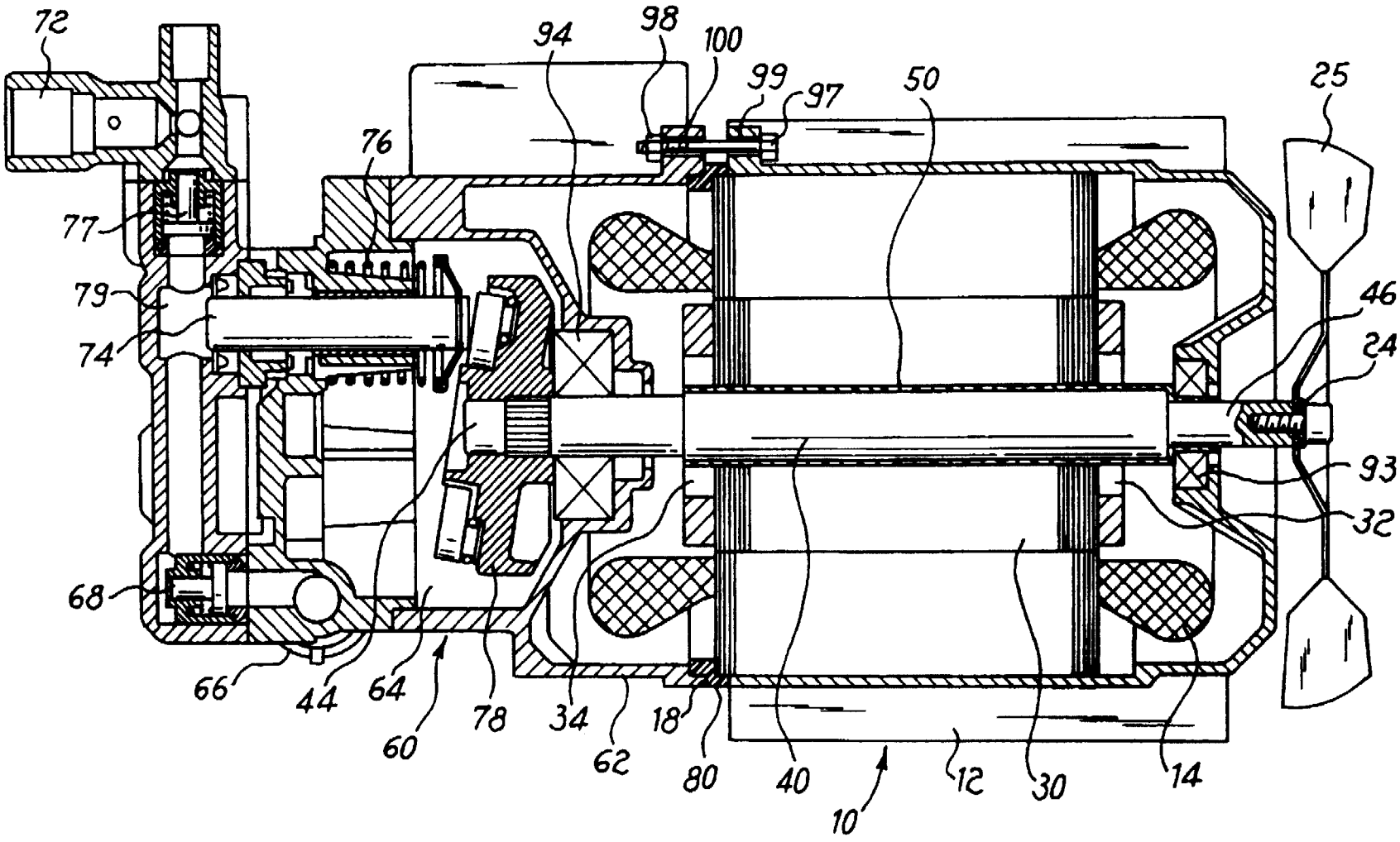
FIGS. 4 and 5 are side cross-section views of embodiment of an electric motor driven double insulated pump of this invention.
Figure 5:
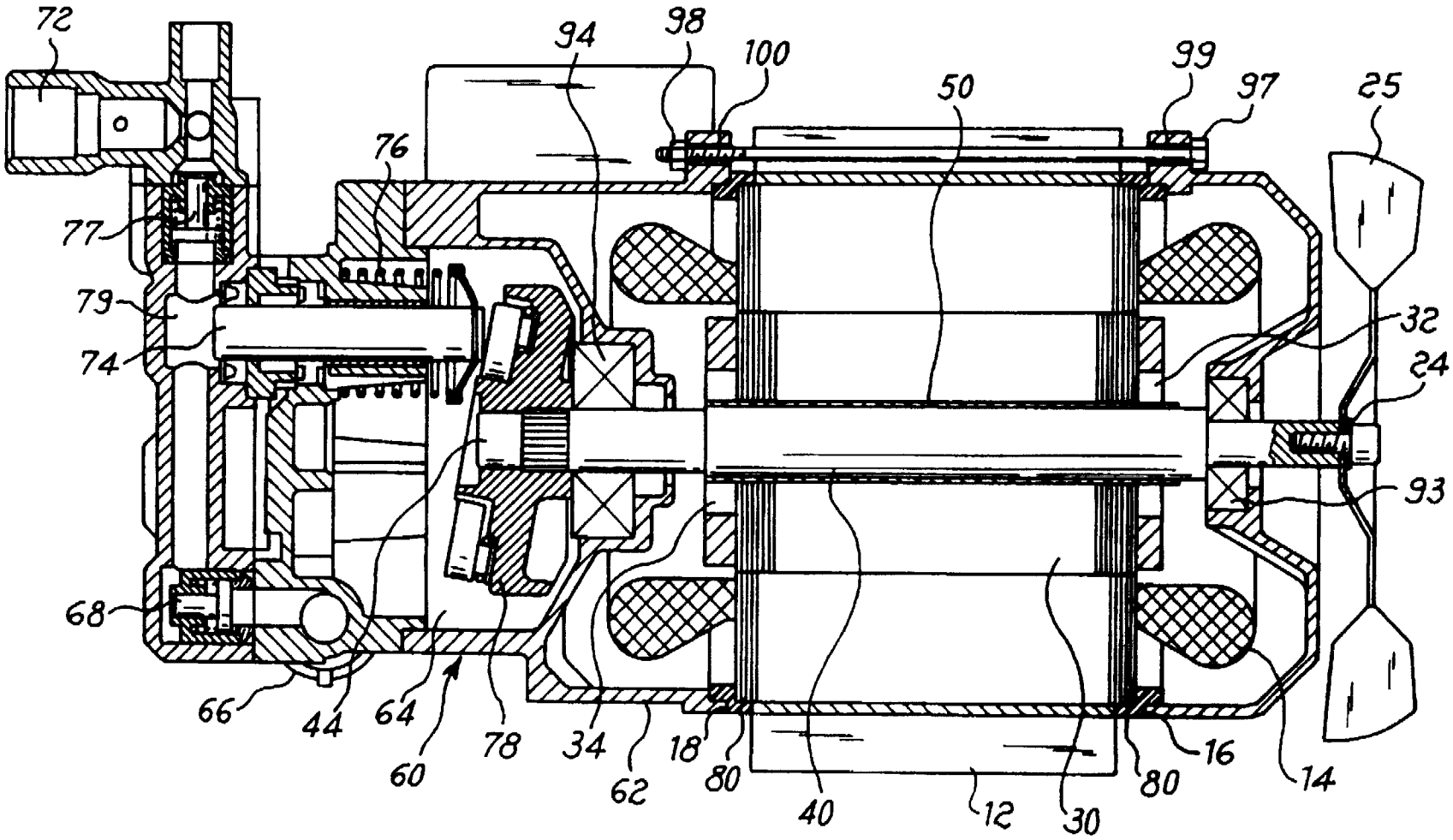

FIGS. 4 and 5 show cutaway views of embodiments of the electric motor driven high pressure water pump system 10 of this invention. As shown in FIGS. 4 and 5, axial drive pump 60 is associated with one end of electric motor 12 while fan 25 is associated with the opposite end of electric motor 12. Electric motor 12 may be an electric motor capable of rotating drive shaft 40 with sufficient power to directly drive axial drive pump 60. It is preferred that electric motor 12 is an electric induction motor.

Figure 6B:
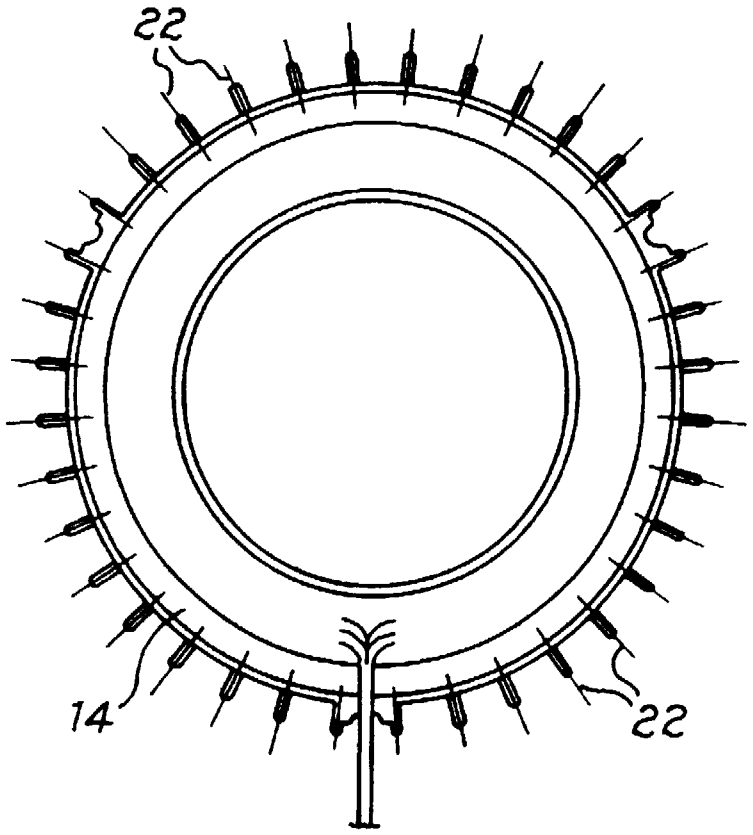
FIGS. 6A and 6B are end and side cross-section views respectively of a stator associated with an electric motor driven high pressure pump of this invention.
Figure 6A:
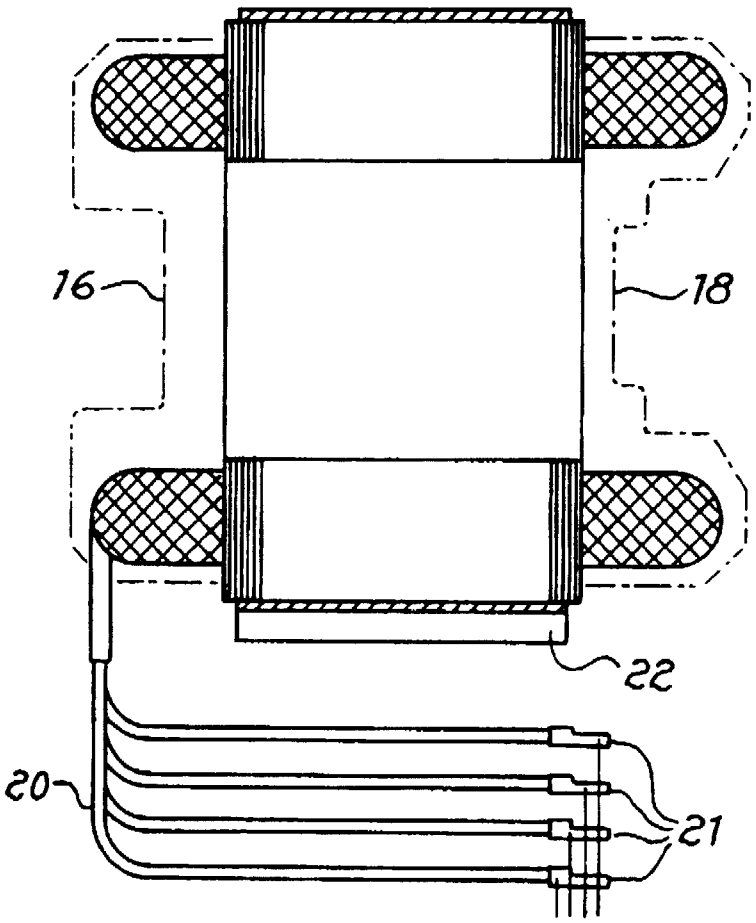
Figure 7B:
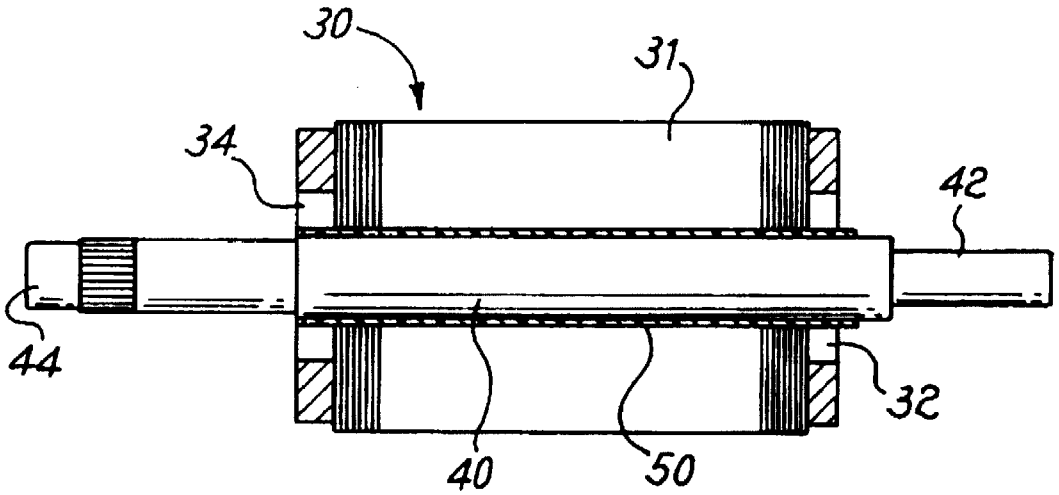
FIGS. 7A and 7B are end and side cross-section views respectively of a rotor associated with the high pressure pump of this invention.
Figure 7A:
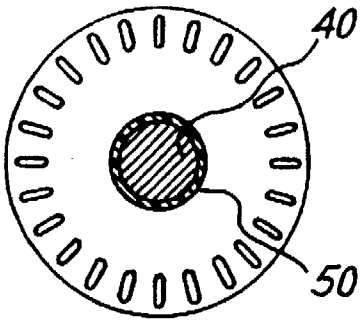

Preferred electric motor 12 includes a stator 14, shown in more detail in FIGS. 6A and 6B. Stator 14 includes first end 16 associated with fan 25 and/or fan housing 24 and second end 18 associated with axial drive pump 60. Stator 14 is cylindrical in shape with a hollow center surrounded by wire windings. Stator 14 includes veins 22 running the length of the stator and uniformly spaced arount its circumference.

An electric cable 20 includes lead wires 21 that unite stator 14 with a source of electricity. Electric cable 20 will tipically be a standard multiple lead insulated cord that ends in a plug compatible with a household or industrial electrical source.

Electric motor 12 includes a rotor 30 complementary to stator 14. Rotor 30 is smaller in diameter than stator 14 and fits within the hollow cylindrical space defined by stator 14. Rotor 30 is cylindrical in shape and has a hollow core 31 with a first open end 32 and a second open end 34. Rotor 30 and stator 14 do not touch. Instead, rotor 30 is made of magnetically responsive material that is induced to rotate by the electric current in stator 14.

Rotor 30 is fixedly associated with drive shaft 40 and rotation of stator 14 causes drive shaft 40 to rotate in unison. Rotor 30 may be fixedly associated with drive shaft 40 in any manner that allows the combination to rotate simutaneously. Thus, rotor 30 may be mechanically attached to drive shaft 40 with screws, it may be adhesively associated with drive shaft 40, or in a preferred embodiment, rotor 30 is press fit over drive shaft 40.

Drive shaft 40 has a first end 42 and second end 44. Drive shaft first end 42 is associated with fan 25 and includes a reduced diameter section 46. The reduced diameter section 46 is associated with a first bearing 93 fixedly associated with electric motor 12 or alternatively with fan housing 24. It is preferred the first bearing 93 is a thrust bearing. Drive shaft second end 44 passes through second bearing 94. Second bearing 94 is associated with pump housing 62 and drive shaft 40 is preferably press fit into second bearing 94. It is preferred that second bearing 94 is a roller bearing. First bearing 93 and second bearing 94 fix the axis of rotation of drive shaft 40 while allowing the drive shaft to freely rotate around the axis.

A drive shaft insulator 50 is located between rotor 30 and drive shaft 40. Drive shaft insulator 50 electrically insulates rotor 30 from drive shaft 40 thereby preventing an electrical current from passing from electric motor 12 into drive shaft 40 via rotor 30. Drive shaft insulator 50 can be manufactured out of any electrically insulating material. However, drive shaft insulator 50 must have sufficient mechanical strength to ensure that rotor 30 and drive shaft 40 remain fixedly united so that drive shaft 40 and rotor 30 rotate simultaneously when rotor 30 is press fit over drive shaft insulator 50 and drive shaft 40 preferred drive shaft insulator is a plastic insulating material. It has been discovered, however, that some plastic insulating materials are capable of fixedly uniting rotor 30 and drive shaft 40 for long periods without sippage, while other plastic insulating materials fail relatively quickly and allow slippage between rotor 30 and drive shaft 40. Araldite NU 510 manufactured by Ciba Geigy has longer life expectancy as a drive shaft insulator 50 than other plastic insulating materials tested.

Drive shaft insulator 50 may have a length corresponding to the length of rotor 30 as shown in FIG. 5 or it may be much longer in length than rotor 30 and extend and cover reduced diameter section 46 of drive shaft 40 as shown in FIG. 4. It is preferred that drive shaft insulator is at least slightly longer in length than rotor 30. The extent to which drive shaft insulator 50 insulates drive shaft 40 will depend upon whether or not the electric motor driven high pressure water pump system 10 includes a fan separate housing 24, as depicted in FIG. 5.

Figure 3A:
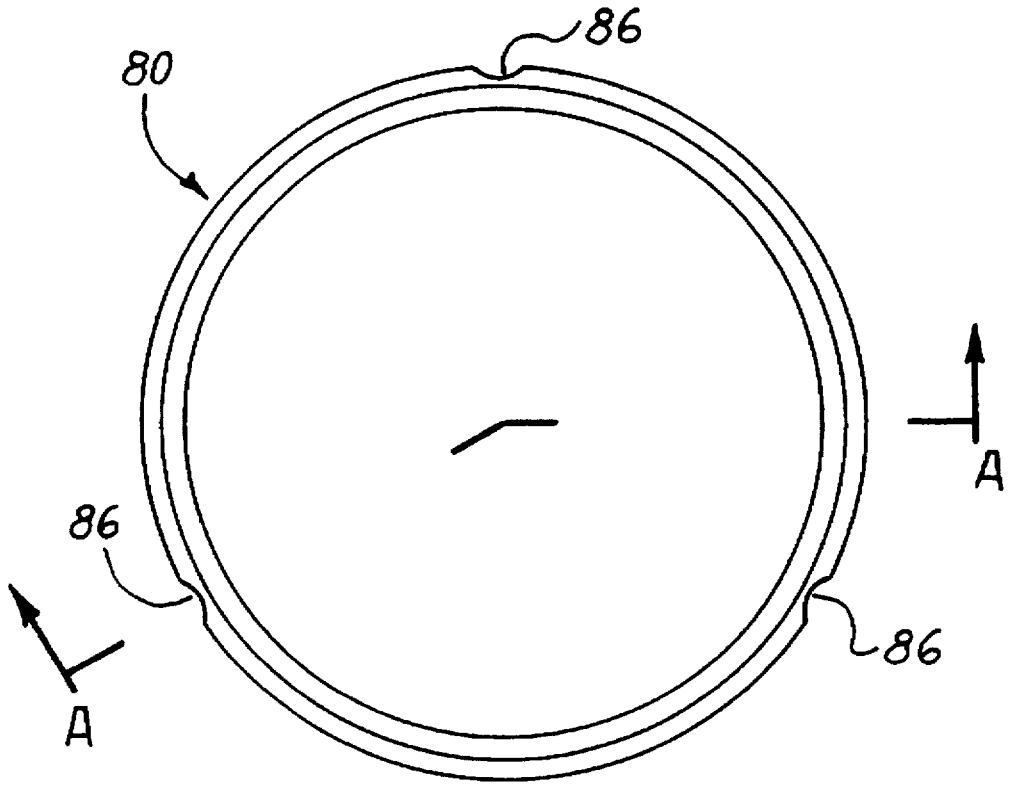
FIG. 3A is a top view of an insulator ring associated with an electric motor driven double insulated pump of this invention.
Figure 3B:
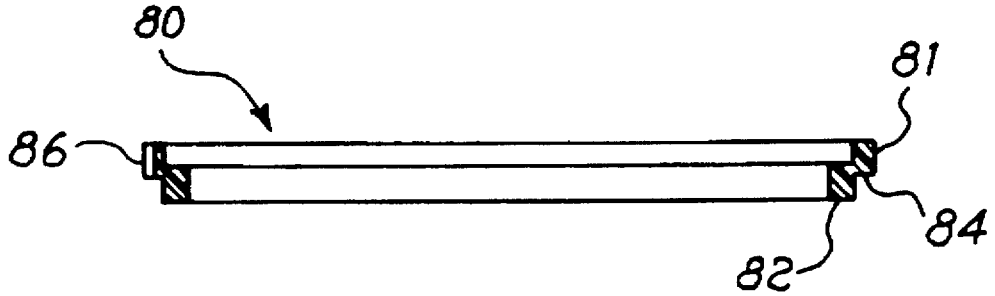
FIG. 3B is a cross-section view of the insulator ring of FIG. 3A with a plane passing through line A—A.

Even after drive shaft insulator 50 is associated with drive shaft 40, there remains one more possible point of egress of electric current from electric motor 12. These possible points of egress are insulated by a second insulator, insulator ring 80, shown in FIGS. 3A and 3B. Depending upon the configuration of the electric motor drive high pressure water pump system 10 of this invention, an insulator ring 80 may be associated with second end 18 of stator 14 or, as shown in FIG. 4, alternatively with first end 16 and second end 18 of stator 14 as shown in FIG. 5. Insulator ring 80 is essentially identical in diameter to the outside diameter of slightly larger stator 14. Insulator ring 80 is made up of two concentric rings: a first ring 81 having a slighty greater diameter than and a second ring 82. The combination of first ring 81 and second ring 82 defines a ledge 84. Ledge 84 abuts the first end 16 or second end 18 of stator 14 around its entire circumference and prevents pump housing 62 and in some embodiments, fan housing 24, from contacting electric motor 12 in a way that might allow an electrical current to exit electric motor 12.

Insulating ring 80 may be made of any type of electrically insulating material. It is preferred that isolating ring 80 is manufactured from a hard plastic electrically inert insulating material. It is most preferred that insulating ring 80 is manufactured from Akulon K224 K46 manufactured by DSN—Netherlands or from Sniamid ASN 27/300 SR, manufactured by SNIA—Italy.

The double insulated electric motor drive high pressure pump system 10 of this invention may include one or two insulator rings 80. FIG. 4 shows an embodiment of this invention that includes a single first insulator ring 80: the insulator ring electrically separates electric motor 12 from pump housing 62. FIG. 5 shows an alternative embodiment including two insulator rings 80. Like FIG. 4, one insulator ring is located between the circumference of the second end of stator 14 and pump housing 62. In addition, a second insulator ring 80 is located between stator first end 16 and fan housing 24. In the first embodiment, the fan 25 is electrically isolated from electric motor 12 by drive shaft insulator 50. In the embodiment of this invention shown in FIG. 5, fan housing 24 and fan 25 are electrically isolated from electric motor 12 by second insulator ring 80. The combination of drive shaft insulator 50 and one or two insulator rings 80 together effectively insulate pump housing 62, fan 25 and fan housing 24 from coming into electric contact with electric motor 12. This protects the user of the electric motor driven high pressure pump system 10 of this invention from receiving an electric shock.

Any type of axial driven pump may be used with this invention. It is preferred that an axial drive piston pump 16 be associated with electric motor 12. FIGS. 4 and 5 show various aspects of the preferred axial drive piston pump 60 useful in this invention.

The inlet port 66 and the outlet port 72 emanating from the plastic high pressure water pump housing 62 are manufactured out of plastic to ensure that the pump operator will never be able to touch and never be exposed to any metal parts that could conceivably be electrically associated with the pump housing 62 or the electric motor housing.

In order to ensure also in drastic conditions the electrical insulation between the user and the pump also when water enters within the motor housing, nipples made of insulating material are mounted on the inlet 66 and outlet 72 ports.

The preferred axial drive piston pump 60 includes three pistons which operate in unison to produce a constant high pressure stream of water.

Electric motor 12 and pump housing 62 in case of the embodiment shown in FIG. 5, fan housing 24 must be attached to one another by a method that electrically isolates electric motor 12. It is achieved, as shown in FIG. 5, by including a plurality of first bolts guides 99 associated with fan housing 24 that correspond with identically oriented second bolt guides 100 associated with pump housing 62. Bolt 97 having a length in excess of the length of electric motor 12 is placed in first bolt guide 99 and through second bolt guide 100 where it is united with nut 98. Nut 98 is tightened to compress electric motor 12 between fan housing 24 and pump housing 62. Insulator ring 80 includes convex recesses 86 evenly spaced around its outside circumference. Each convex recess 86 allows bolt 97 to traverse the distance between fan housing 24 and pump housing 62 without impediment. There should be a sufficient number of attaching sites around the circumference of the high pressure pump 10 to ensure that electric motor 12 is uniformly compressed between pump housing 62 and fan housing 24. For example, there may be four bolts traversing the electric motor 12 spaced at 90° intervals or alternatively, and preferably, there may be three securing bolts spaced at 120° intervals around the circumference of electric motor driven high pressure pump system 10 of this invention. The use of nuts and bolts as shown in FIG. 5 is just an example of a means for compressing electric motor 12 between pump housing 62 and fan housing 24. Other securing methods known to those in the art may be used instead of nuts and bolts.

The description above has been offered for illustrative purposes only, and it is not intended to limit the scope of the invention of the application which is defined in the following claims.

What we claim is:

1. A high pressure water pump comprising:

an electric motor including a stator having a first end and a second end, and an electric cable coupled the stator;

said electric motor having a hollow rotor core with first and second open ends;

a fan adjacent the first end of said stator;

an axial drive pump adjacent the second end of the stator;

a drive shaft having a first end coupled to said fan and a second end coupled to the axial drive pump, said drive shaft being press fit into the hollow rotor core such that the first and second drive shaft ends extends beyond the first and second open rotor ends; and a drive shaft insulator ring located between the stator second end and the axial drive pump.

2. The high pressure water pump of claim 1, wherein the axial drive pump is an axial drive piston pump.

3. The high pressure water pump of claim 1, wherein the rotor is press fit over the drive shaft insulator ring and the drive shaft.

4. The high pressure water pump of claim 1, wherein the drive shaft insulator is complementary to and essentially equivalent in length to a cylindrical rotor.

5. The high pressure water pump of claim 1, wherein the first end of the drive shaft has a reduced diameter section that is covered by the drive shaft insulator.

6. The high pressure water pump of claim 1, wherein a fan housing abuts the first stator end and is separated from the first stator end by a second insulator ring.

7. The high pressure water pump of claim 1, wherein said fan and pump each have a respective housing, and a plurality of bolts secure the electric motor between the pump and the fan housing.

8. A high pressure water pump comprising:

an electric motor including a stator having a first end and a second end, a cylindrical rotor having a hollow core with a first open end, and an electric cable coupled with the stator;

a fan adjacent the first end of said stator;

an axial drive piston pump adjacent the second end of the stator;

a drive shaft having a first end with a reduced diameter section coupled to said fan and a second end coupled to the axial drive pump, the drive shaft being press fit into the hollow rotor core such that the first and second drive shaft ends extend beyond the first and second open ends of the cylindrical rotor;

a drive shaft insulator located between the drive shaft and the rotor and extending beyond the first end of the cylindrical rotor to cover the reduced diameter section of the drive shaft; and a first insulator ring located between the stator second end and the pump.

9. The high pressure water pump of claim 8, wherein the drive shaft insulator is made of Araldite NU 510.

10. The high pressure water pump of claim 8, wherein a plurality of bolts each having a first end and a second end secure the electric rotor between the pump and a fan housing.

11. A high pressure water pump comprising:

an electric motor including a stator having a first end and a second end, a cylindrical rotor having a hollow core with a first open and a second open end, and an electrically conductive cable coupled to said stator;

a fan adjacent the first end of said stator;

an axial drive piston pump adjacent the second end of the stator;

a drive shaft having a first end coupled to the fan and a second end coupled to the axial drive pump, the drive shaft being press fit into the hollow rotor core such that the first and second drive shaft ends extend beyond the first and second open ends of the cylindrical rotor;

a drive shaft insulator located between the drive shaft and the rotor;

a first insulator ring located between the stator second end and the pump; and a second insulator ring located between the stator first end and a fan housing.

* * * * *

UNITED STATES PATENT AND TRADEMARK OFFICE

CERTIFICATE OF CORRECTION

PATENT NO. : 5,741,124
DATED : April 21, 1998
INVENTOR(S) : Roberto Mazzucato, Carlo A. Cuneo and Gus Alexander It is certified that error appears in the above-identified patent and that said Letters Patent is hereby corrected as shown below:

On the Title Page add:

[30] Foreign Application Priority Data

July 12, 1995 [IT] Italy.....MI95 A 001494

Signed and Sealed this

Nineteenth Day of June, 2001

*Attest:*

Nicholas P. Godici

*Attesting Officer*

NICHOLAS P. GODICI
*Acting Director of the United States Patent and Trademark Office*